United States Patent [19]

Hermes

[11] 4,047,889

[45] Sept. 13, 1977

[54] PROCESS FOR THE RAPID, CONTINUOUS AND WATERLESS DYEING OF TEXTILE AND PLASTIC MATERIALS

[75] Inventor: Julius Hermes, Martinsville, Va.

[73] Assignee: Martin Processing, Inc., Martinsville, Va.

[21] Appl. No.: 647,775

[22] Filed: Jan. 9, 1976

[51] Int. Cl.[2] ..... C09B 67/00; D06P 1/64

[52] U.S. Cl. ..... 8/93; 8/54.2; 8/142; 8/147; 8/158; 8/173; 8/177 R; 8/178 R; 8/179

[58] Field of Search ..... 8/93, 173, 147, 158

[56] References Cited

U.S. PATENT DOCUMENTS 2,882,119 4/1959 Laucius et al. ..... 8/55

FOREIGN PATENT DOCUMENTS 955,260 1/1950 France

OTHER PUBLICATIONS

Farben Revue, "Dyeing from Organic Solvents", 1971, Special Edition 13, pp. 78–97.

Peters, "Textile Chemistry", (Elsevier, 1975) pp. 741–753.

*Primary Examiner*—Joseph L. Schofer

*Assistant Examiner*—A. L. Clingman

*Attorney, Agent, or Firm*—Stevens, Davis, Miller & Mosher

[57] ABSTRACT

A process is disclosed for the rapid, continuous and waterless dyeing of textile and plastic materials in which the dyestuff is dissolved, suspended or dispersed in a high boiling solvent, such as glycol or glycol ether, for carrying out the dyeing step per se, after which the dyed textile or plastic material (after cooling if desired) is subjected to a washing with a low boiling liquid such as methanol or ethanol (preferably the former) or a chlorinated hydrocarbon solvent, and subsequently dried. The entire series of operations is carried out under nonaqueous or substantially nonaqueous conditions with the complete or substantially complete recovery and recycling of the used dyestuff, the used high boiling solvent, and the used low boiling wash liquid. In this way the entire operation is conducted in a relatively inexpensive fashion and in a completely or substantially completely closed cyclic system with essentially complete recovery and reuse of the treating liquids so that not only is the cost of the overall operation greatly minimized, but also without any need for pollution of natural water resources such as rivers and wells such as has in the past taken place to a more or less serious extent where effluents of a substantially aqueous nature but containing serious amounts of polluting substances were discharged into rivers and the like thereby creating environmental problems.

6 Claims, 1 Drawing Figure

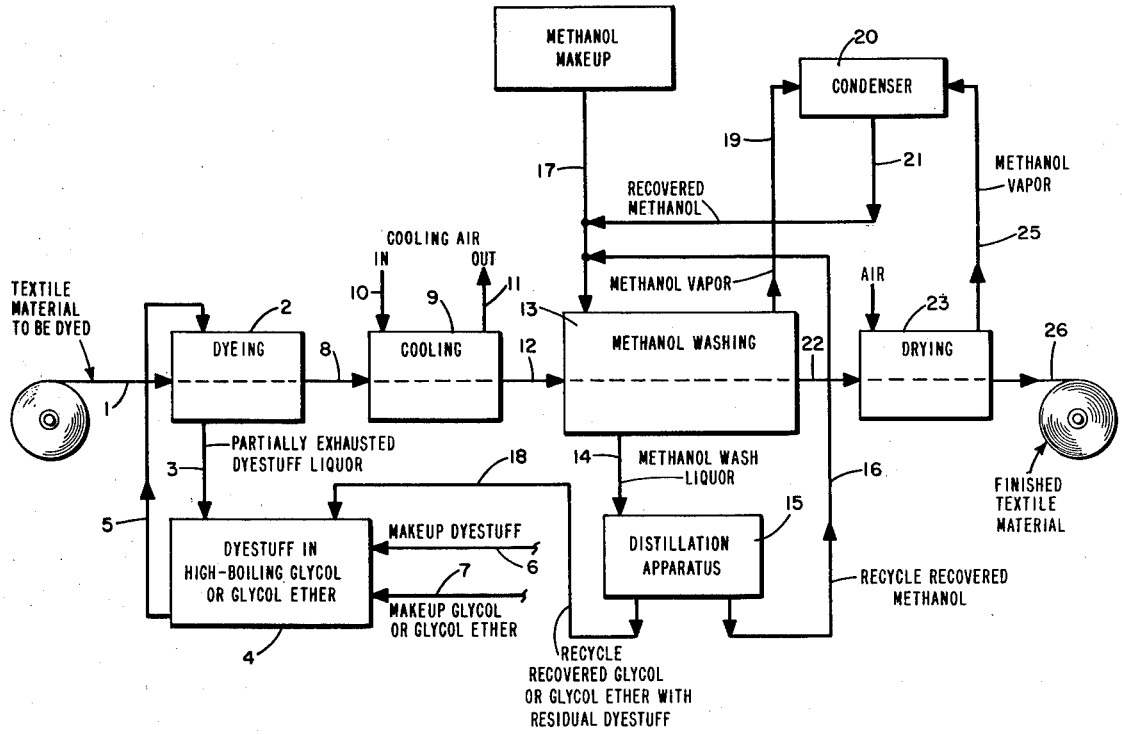

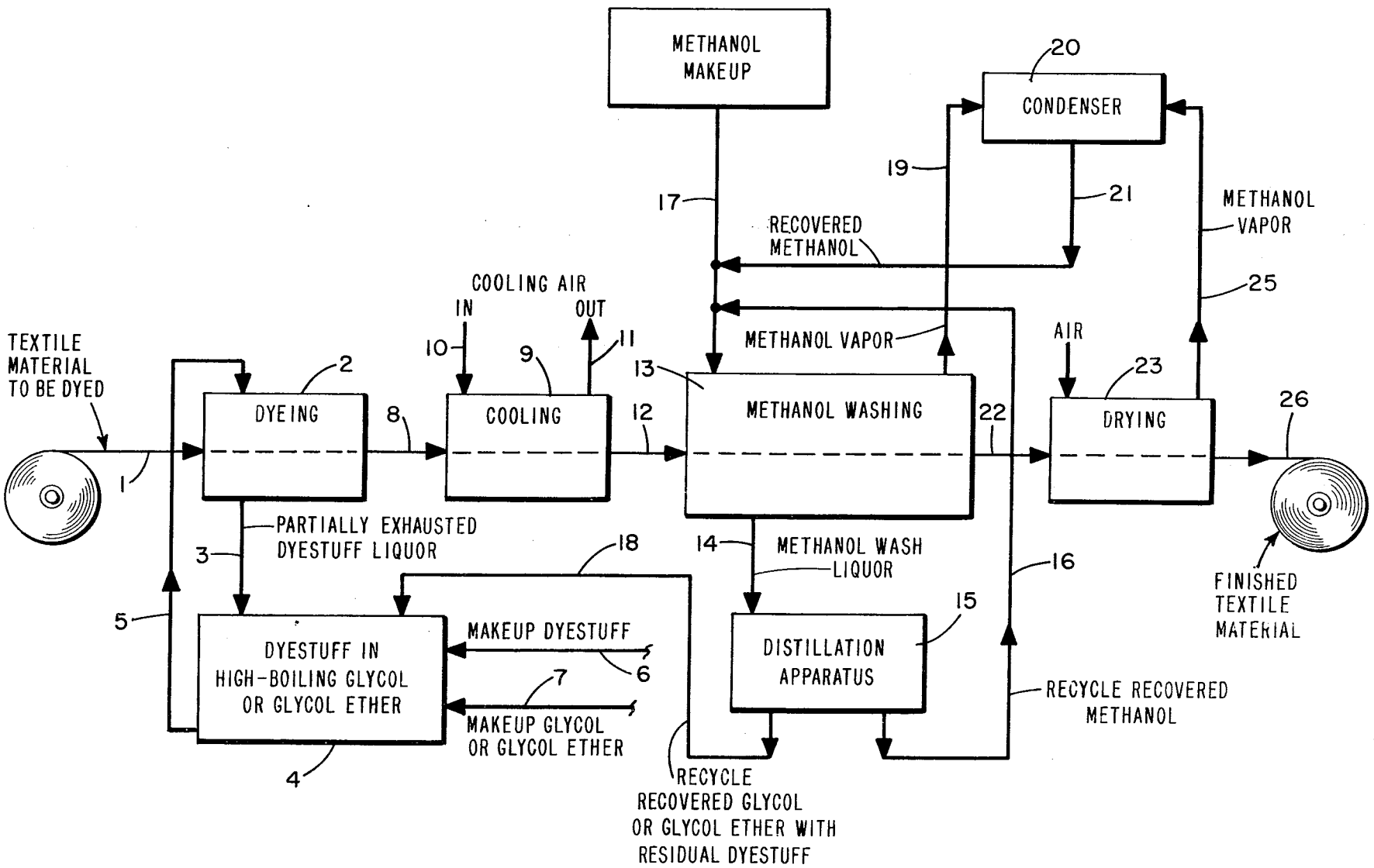
METHANOL VAPOR
25
26
FINISHED TEXTILE MATERIAL
CONDENSER
20
21
DRYING
23
AIR
RECYCLE RECOVERED METHANOL
16
22
19
RECOVERED METHANOL
METHANOL VAPOR
METHANOL WASHING
METHANOL WASH LIQUOR
15
DISTILLATION APPARATUS
METHANOL MAKEUP
17
13
14
RECYCLE RECOVERED GLYCOL OR GLYCOL ETHER WITH RESIDUAL DYESTUFF
12
11
COOLING AIR OUT
COOLING
9
IN
10
18
MAKEUP DYESTUFF
6
7
MAKEUP GLYCOL OR GLYCOL ETHER
8
PARTIALLY EXHAUSTED DYESTUFF LIQUOR
2
DYEING
3
DYESTUFF IN HIGH-BOILING GLYCOL OR GLYCOL ETHER
4
5
1
TEXTILE MATERIAL TO BE DYED

PROCESS FOR THE RAPID, CONTINUOUS AND WATERLESS DYEING OF TEXTILE AND PLASTIC MATERIALS

This invention relates to the rapid, continuous and waterless or essentially waterless dyeing of textile and plastic materials.

With the current emphasis upon pollution control, it is evident that more effective measures for pollution control are becoming increasingly necessary in view of the stringency of such controls, to say nothing of the cost. In the case of dye plants, it is extremely expensive to treat the effluents from such plants and in some cases a treatment sufficient to bring about approval by environmental protection authorities for the discharge of effluents from the dye plants into ground water (whether in the form of rivers or wells or the like) is in fact prohibitively expensive. Indeed, there are communities throughout various parts of the world that do not allow dyeing and finishing plants to be located within their borders.

The present invention has for its object a process for dyeing textile and plastic materials that will eliminate all polluting effluents as well as air pollution that might otherwise result from the dyeing operation.

After the initial capital expenditure for the necessary machinery, the process described hereinafter is relatively inexpensive and moreover requires considerably less energy to keep it in operation. The latter feature is in and of itself a further extremely attractive feature of the process in these critical days of energy shortages.

The process of the present invention involves dyeing the textile or plastic materials with the dyestuff dissolved, suspended or dispersed in a relatively high boiling liquid such as a glycol or glycol ether, and after the dyeing operation washing the dyed material in a relatively low boiling liquid such as methanol or ethanol or a relatively low boiling chlorinated hydrocarbon solvent such as $CH_2Cl_2$, $CCl_4$ or $CHCl_3$. The wash liquor is then subjected to suitable treatment for recovery and/or separation of the components thereof, such as by distillation at a relatively low temperature, which enables the low boiling liquid to be taken over as vapor and thereafter readily condensed, while the high boilin liquid and residual color or dyestuff remain. The distilled low boiling liquid is recovered and continuously recycled through the washing apparatus while the high boiling liquid containing the residual color is recycled through the dyeing apparatus, after suitably replenishing the color or dyestuff which has been absorbed by the textile material passing through the process.

The dyeing process of the present invention is particularly desirable in connection with the dyeing of polyester textile materials, by which is meant a textile material based upon polyethylene terephthalate or the like, but is not limited to the dyeing of such materials. It may be applied to the dyeing of nylon, acrylic, or other well known commercial textile materials. The textile material undergoing the dyeing operation may be in any of the conventional forms well known in the art, such as continuous filament yarn, staple yarn, tow, fabric or the like. The yarn may be in the form of a warp of yarn comprising dozens or even hundreds of individual yarn ends.

Although the dyeing of polyester material has advanced considerably in recent years, in most cases it is still necessary to use dyeing assistants such as phenol derivatives. These phenol derivatives are extremely difficult to remove from the effluents of the dyeing operation, and accordingly, the present process represents an especially attractive way of avoiding difficulties from this particular source. Moreover, the dyeing process of the present invention allows a textile plant, and especially the dyehouse, to be located in a water-poor area.

After the textile material has been washed in the low boiling liquid, such as methanol, for example, the textile material is passed after the washing operation into a low temperature dryer in order to remove and recover all traces of methanol.

Although the dyeing step per se may be carried out in any desired manner, one particularly effective way of doing so without departing from the spirit and scope of the present invention is to proceed as described in connection with the apparatus disclosed in my U.S. Pat. No. 3,558,260, granted Jan. 26, 1971.

After the textile material leaves the dyeing apparatus, it is preferably passed through a cooling zone where its temperature is reduced from an elevated temperature just below the boiling point of the low boiling solvent to (for example) about 140° F, after which it is then passed through a washer where it is washed with the low boiling liquid such as (and preferably) methanol.

The washing step may be carried out in any conventional manner, although preferably I employ a cascade washing system involving a series of washing steps according to which the methanol is introduced just ahead of the point where the textile or plastic material leaves the washer and then is passed concurrently with respect to the direction of movement of the textile material and through a series of "cascade" zones back to a point just after the textile material enters the washing apparatus where the concentration of high boiling liquid and residual unfixed color or dyestuff carried therein is the greatest.

The methanol or other low boiling wash liquor is then passed to a suitable separatory device such as distillation apparatus where the methanol is distilled off at a relatively low temperature, condensed, and then returned to the methanol washing device.

The textile material after passing through the low boiling liquid washing device is then passed into a low temperature dryer to evaporate residual low boiling liquid (e.g., methanol) still clinging to the textile material. The methanol thus evaporated is passed overhead to a condenser where it is condensed and returned to the methanol washing step. The textile material then leaves the dryer in finished form ready for such further treatment as any dyed textile material may be conventionally treated thereafter.

As indicated above, the partially exhausted dyestuff liquor leaving the dyeing step is recycled to the dyeing step, after addition of make-up dyestuff as desired and/or make-up glycol or glycol ether as desired, as well as with the addition of the glycol or glycol ether recovered from the distillation apparatus.

After a given dyelot of textile material has been completed, the glycol or glycol ether containing the dyestuff may be separately stored and used again when a similar shade of dyeing is to be repeated. In the meantime, the dyeing apparatus can be cleaned very readily with the low boiling liquid, such as methanol, and the methanol thus employed may be returned to the distillation unit for purification and separation and recycling to the methanol washing step for the next dyelot.

The process of the present invention may be further illustrated by reference to the accompanying drawing where the various steps are shown in schematic fashion.

Reference numeral 1 represents the incoming textile material to be dyed which passes into the dyeing apparatus 2. There it is subjected to the action of an appropriate dyestuff dissolved, suspended or dispersed in a suitable high boiling liquid such as ethylene glycol, diethylene glycol, triethylene glycol, tetraethylene glycol, propylene glycol, or the methyl- or ethyl- mono- or di-ether of such glycols.

The partially exhausted dyestuff liquor is removed from the dyeing apparatus 2 via line 3 from which it passes to a storage or sump for the residual dyestuff-high boiling liquid mixture. From sump 4 the dyestuff-high boiling liquid mixture is recycled via line 5 to the dyeing apparatus 2.

Make-up dyestuff is added when and as needed via line 6 and make-up high boiling liquid is added when and as needed via line 7.

The dyed textile material leaves the dyeing apparatus 2 after having most of the residual or non-fixed dyestuff and residual high boiling liquid removed therefrom by conventional means (not shown) such as by passing the textile material between squeeze rolls near the exit end of the dyeing apparatus.

The textile material passes as shown at 8 to a cooling chamber 9. There the dyed textile material is cooled from a temperature of just below the normal boiling point of the low boiling solvent down to a temperature of (for example) about 140° F by passing cooling air into the cooling chamber 9 via line 10 and out via line 11.

The dyed material, now cooled, is shown at 12 as passing into a low boiling liquid washing device 13 where it is subjected to washing to remove residual high-boiling liquid and residual (non-fixed) dyestuff. The wash liquid may conveniently be methanol or other low boiling aliphatic alcohol or a chlorinated hydrocarbon of the kind mentioned above.

Wash liquor leaves the methanol washer 13 via line 14 and is passed to recover apparatus 15 which may suitably take the form of distillation apparatus. There the relatively volatile low boiling liquid, such as methanol, is vaporized and returned via line 16 through a condenser (not shown) to the methanol washing apparatus 13. Make-up methanol may be introduced when and as needed via line 17.

Returning to the separatory or distillation apparatus 15, the recovered high boiling liquid with the residual dyestuff which remains after the vaporization of the methanol therefrom is recycled via line 18 to the partially exhausted dyestuff liquor sump 4, whereby it is returned to the dyeing operation carried out in dyeing apparatus 2.

Returning to the methanol washing apparatus 13, vapors of the relatively low boiling washing liquid, such as methanol, are removed via line 19 by which they are passed to a condenser 20. The vapors are thereby condensed to liquid form and the liquid is recycled to the methanol washing device 13 via line 21.

The textile material after the washing step is passed as shown by reference numeral 22 into the dryer 23 where it is contacted with air introduced via line 24. This air may be warm or hot, as obtained from a heating device (not shown). The air passes through and/or in contact with the washed textile material, picking up residual low boiling liquid still clinging to the textile material, and leaves the drying device 23 via line 25. The air leaving via line 25, and carrying vapors of the low boiling liquid, is then passed into the condenser 20 where the low boiling liquid is recovered and recycled to the methanol washing step via line 21. The air is removed from the condenser 20 via conventional vent means not shown.

In this manner the dyed, (optionally) cooled, washed and dried textile or plastic material leaves the dryer 23 as shown at 26 as a finished dyed textile or plastic material ready for such other textile treating operations as may be desired.

It will be noted from the description of the schematic drawing thus described that the material flow is completely cyclic in nature with no or essentially no liquid effluents from the system. Consequently, the system is completely free from problems normally associated with dye plants where aqueous or largely aqueous systems are involved and wherein the aqueous systems at some point or another must be discharged from the plant into rivers or wells or other surface water thereby creating effluent problems of an environmentally undesirable nature. Moreover, the use of the low boiling liquid for washing purposes requires a significantly lesser energy input to the system, which is an additional highly desirable feature of the process.

By way of still further illustration, the following examples of dyeing are set forth:

EXAMPLE 1

A nylon fabric, type 66, is dyed in ethylene glycol containing ½% of Acid Blue No. 25. The sample is dyed at 300° F for 12 seconds. After cooling, the sample is washed in methanol and then dried at a low temperature. This dyeing gives a heavy blue shade with much better fastness properties than dyeing by conventional methods. Moreover, the partially exhausted dyestuff liquor after addition of makeup ethylene glycol is returned to the dyeing operation. The wash methanol is distilled for recovery and recycling of recovered methanol.

EXAMPLE 2

A polyester fabric is dyed in dye-liquor containing ethylene glycol and ½% of Disperse Blue No. 56. The polyester material is dyed at 320° F for 30 seconds. After dyeing, the sample is then washed in methanol and dried at a low temperature. The dyeing results in a full blue with excellent fastness properties. Separation and recovery of both the ethylene glycol and methanol may be as described above.

EXAMPLE 3

A wool fabric is dyed in ethylene glycol containing ½% of Acid Blue No. 25. The sample is dyed at 300° F for 12 seconds. After cooling, the sample is washed in methanol and then dried at a low temperature. This dyeing gives a heavy blue shade with much better fastness properties than dyeing by conventional methods. Moreover, the partially exhausted dyestuff liquor after addition of makeup ethylene glycol is returned to the dyeing operation. The wash methanol is distilled for recovery and recycling of recovered material in the manner described above.

EXAMPLE 4

An acrylic fabric is dyed in a dye-liquor containing ethylene glycol and ½% of Disperse Blue No. 56. The acrylic material is dyed at 320° F for 30 seconds. After dyeing, the sample is then washed in methanol and dried at a low temperature. The dyeing results in a full blue with excellent fastness properties. Separation and recovery of both the ethylene glycol and methanol may be as described above.

It should be noted in passing that I do not claim to be the first to have suggested the step of dyeing a textile material in a nonaqueous dye bath such as a glycol or a glycol ether. Societa Rhodiaceta's French Pat. No. 955,260 (and the generally corresponding Swiss Pat. No. 230,891) suggested such a step for the dyeing of nylon many years ago. Moreover, more recently Laucius et al, in U.S. Pat. No. 2,882,119, suggested the dyeing of polyester in a nonaqueous dyebath comprising various glycols. See also Olpin et al U.S. Pat. No. 2,461,612. Moreover, I do not claim to be the first to suggest the step per se of washing dyed textile products with a low boiling liquid, such as an alcohol, because that too was suggested in the Rhodiaceta patents mentioned above, although there it is a matter of indifference whether water or a low boiling alcohol is employed as the washing liquid. See the French patent at page 2, lines 58 et seq. However, neither the prior art just cited nor any other prior art, so far as I am aware, has suggested, much less recognized, the desirability of operating the dyeing and washing steps in the manner indicated herein with complete recycling of the various materials involved and with a completely or substantially completely non-aqueous system, for the sake of lesser costs, and more importantly, with a view to present-day environmental and energy-conservation considerations.

It is to be particularly noted in connection with the present invention that it conveniently provides what is in effect a non-aqueous or substantially non-aqueous closed or essentially closed treating system, and therefore with no need to discharge potentially polluting aqueous wastes to ground water. If as a result of long-continued operation a build-up of significant (though still relatively small) amounts of water should occur, such as from the use of aqueous dye concentrates to make up the dilute dyestuff-high boiling organic liquid treating solution and/or from moisture unavoidably present in the air used for the cooling and drying steps, such water can be easily removed from any of the treating liquids by conventional means (not shown) such as by passing same through a bed of a commercial dehydrating agent such as Drierite.

What is claimed is:

1. A process comprising dyeing a textile or plastic material with a dyestuff dissolved or suspended or dispersed in a high boiling organic liquid which is free or substantially free of water and at a relatively high temperature, followed by cooling the dyed textile or plastic material and washing same with a low boiling organic liquid which is free or substantially free of water, followed by drying the washed and dyed textile or plastic material, and carrying out the dyeing, the washing, and the drying steps in cyclic manner and in an essentially closed system with the partially exhausted dyestuff liquor from the dyeing step being recycled for the treatment of further textile or plastic material to be dyed, with the separation and recovery of used low boiling wash liquid with recovered low boiling wash liquid being recycled to the washing step and residual high boiling liquid containing residual dyestuff being recycled to the dyeing step, and with low boiling wash liquid vaporized from the textile material in the drying step being recovered and returned to the low boiling liquid washing step; said high boiling organic liquid being a lower alkylene glycol or a lower alkyl ether of a lower alkylene glycol.

2. A process as defined in claim 1, wherein the high boiling organic liquid is selected from the class consisting of ethylene glycol, diethylene glycol, triethylene glycol, tetraethylene glycol, propylene glycol, and the methyl- and ethylmono- and di-ethers of such glycols.

3. A process as defined in claim 1, wherein the low boiling organic liquid is a lower alkanol.

4. A process as defined in claim 1, wherein the low boiling organic liquid is methanol.

5. A process as defined in claim 1, wherein the low boiling organic liquid is selected from the class consisting of $CH_2Cl_2$, $CCl_4$ and $CHCl_3$.

6. A process as defined in claim 1, wherein the low boiling organic liquid is a chlorinated paraffinic hydrocarbon.

* * * * *